US010184436B2

(12) United States Patent
Shafer et al.

(10) Patent No.: US 10,184,436 B2
(45) Date of Patent: Jan. 22, 2019

(54) FLUID INJECTOR SUPPLY SYSTEM AND METHOD FOR OPERATING SAME

(71) Applicant: Caterpillar Inc., Peoria, IL (US)

(72) Inventors: Scott F. Shafer, Morton, IL (US); Martin Lehman, Congerville, IL (US); Lifeng Wang, Dunlap, IL (US); David E. Hackett, Washington, IL (US); Taylor Tang, Peoria, IL (US); Andrew Marrack, Peoria, IL (US); Dennis H. Gibson, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 643 days.

(21) Appl. No.: 14/802,162

(22) Filed: Jul. 17, 2015

(65) Prior Publication Data

US 2017/0016416 A1 Jan. 19, 2017

(51) Int. Cl.

| | |
|---|---|
| ***F02M 37/08*** | (2006.01) |
| ***F02M 37/00*** | (2006.01) |
| ***F02M 63/02*** | (2006.01) |
| ***F02D 41/30*** | (2006.01) |
| ***F02D 41/38*** | (2006.01) |

(52) U.S. Cl.

CPC ..... *F02M 37/08* (2013.01); *F02D 41/3082* (2013.01); *F02D 41/3845* (2013.01); *F02M 37/0047* (2013.01); *F02M 37/0052* (2013.01); *F02M 63/0225* (2013.01); *F02M 63/0265* (2013.01); *F02D 2041/3881* (2013.01); *F02D 2200/0602* (2013.01); *F02M 2037/087* (2013.01); *F02M 2200/247* (2013.01)

(58) Field of Classification Search

CPC ..... F02M 37/08; F02M 37/0047; F02M 63/0225; F02M 63/0265; F02M 2200/247; F02M 2200/0602; F02M 2037/087; F02D 41/3845

USPC ..... 123/258

See application file for complete search history.

(56) References Cited

U.S. PATENT DOCUMENTS 6,453,878 B1 * 9/2002 Mazet ..... F02D 41/3082 123/497

6,581,574 B1 6/2003 Moran et al.

(Continued)

FOREIGN PATENT DOCUMENTS

KR 1329652 B1 11/2013

*Primary Examiner* — Hieu T Vo

*Assistant Examiner* — Arnold Castro

(74) *Attorney, Agent, or Firm* — Baker Hostetler

(57) ABSTRACT

A fluid injection system includes a fluid injector assembly; a fluid conditioning module having an outlet port that is fluidly coupled to an inlet port of the fluid injector assembly; an injector assembly outlet conduit fluidly coupled to an outlet port of the fluid injector assembly and disposed downstream of the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly; a pressure sensor fluidly coupled to the pressure measurement port; and a controller operatively coupled to the fluid conditioning module and the pressure sensor. The controller is configured to adjust a flowrate of a fluid through the injector assembly inlet conduit based on a pressure signal from the pressure sensor.

20 Claims, 8 Drawing Sheets

(56) References Cited

U.S. PATENT DOCUMENTS

| | | | | |
|---|---|---|---|---|
| 6,840,222 | B2 * | 1/2005 | Schilling | F02D 41/221 123/458 |
| 6,877,488 | B2 | 4/2005 | Washeleski et al. | |
| 7,188,608 | B2 * | 3/2007 | Wilson | F02D 41/064 123/456 |
| 7,540,141 | B2 | 6/2009 | Goldberg et al. | |
| 8,744,725 | B2 * | 6/2014 | Troberg | F02D 41/1401 123/456 |
| 8,844,503 | B2 * | 9/2014 | Worthington | F02M 37/22 123/446 |
| 8,881,529 | B2 | 11/2014 | Wittmann | |
| 2002/0073687 | A1 * | 6/2002 | Lipinski | F02C 7/232 60/39.094 |
| 2005/0058549 | A1 * | 3/2005 | York | F04B 49/20 417/44.2 |
| 2008/0115766 | A1 * | 5/2008 | Ricco | F02M 37/00 123/457 |

* cited by examiner

FLUID INJECTOR SUPPLY SYSTEM AND METHOD FOR OPERATING SAME

TECHNICAL FIELD

The present disclosure relates generally to fluid conditioning systems and, more particularly, to fluid conditioning systems for supplying a fluid to one or more fluid injectors and methods for operating the same.

BACKGROUND

Reciprocating internal combustion (IC) engines are known for converting chemical energy, stored in a fuel supply, into mechanical shaft power. A fuel-oxidizer mixture is received in a variable volume of an IC engine defined by a piston translating within a cylinder bore. The fuel-oxidizer mixture burns inside the variable volume to convert chemical energy from the mixture into heat. In turn, expansion of the combustion products within the variable volume performs work on the piston, which may be transferred to an output shaft of the IC engine.

Combustion engines may inject high pressure liquid fuel directly into the variable volume, and a liquid fuel delivery system may employ two or more fuel pumping stages in series to achieve the desired final injection pressure. For example, unit pump fuel systems for direct injection compression ignition engines may include a fuel transfer pump that draws fuel from a fuel tank and delivers the fuel to the inlet of a unit pump driven by a cam or hydraulic piston, for example, to further increase the fuel pressure to the desired injection pressure.

U.S. patent application Ser. No. 6,581,574 (the '574 patent), purports to address the problem of controlling fuel pressure within the fuel rail of an internal combustion engine. The '574 patent describes a fuel rail delivery system including a fuel rail adapted to deliver fuel to fuel injectors of the internal combustion engine, a fuel pump adapted to deliver fuel to the fuel rail, a fuel pressure sensor, and a fuel pump motor controller. The fuel pressure sensor measures the pressure within the fuel rail and the fuel pump motor controller receives the fuel pressure and calculates the difference between a set-point pressure and the fuel rail pressure.

However, the downstream end of the fuel rail of the '574 patent terminates with a closed or deadheaded boundary at its downstream end which may result in an unduly stiff system with respect to pressure control, as the fluid flow rate leaving the pump must precisely match the sum of fluid flow rates leaving the fuel injectors. Further, measuring the pressure for feedback control within the fuel rail or upstream of the fuel rail may result in a pressure measurement that is not sufficiently representative of pressure supplying downstream injectors. Accordingly, there is a need for improved fuel systems and methods for operating fuel systems to address the aforementioned problems and/or other problems in the art.

It will be appreciated that this background description has been created to aid the reader, and is not to be taken as a concession that any of the indicated problems were themselves known in the art.

SUMMARY

According to an aspect of the disclosure, a fluid injection system comprises a fluid injector assembly; a fluid conditioning module having an outlet port that is fluidly coupled to an inlet port of the fluid injector assembly via an injector assembly inlet conduit; an injector assembly outlet conduit fluidly coupled to an outlet port of the fluid injector assembly and disposed downstream of the fluid injector assembly along a direction of fluid flow through the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly; a pressure sensor fluidly coupled to the pressure measurement port; and a controller operatively coupled to the fluid conditioning module and the pressure sensor. The controller is configured to adjust a flowrate of a fluid through the injector assembly inlet conduit based on a pressure signal from the pressure sensor.

According to another aspect of the disclosure, a machine comprises an internal combustion engine; and a fluid injection system operatively coupled to the internal combustion engine. The fluid injection system includes a fluid injector assembly having at least one fluid injector in fluid communication with the internal combustion engine; a fluid conditioning module having an outlet port that is fluidly coupled to an inlet port of the fluid injector assembly via an injector assembly inlet conduit; an injector assembly outlet conduit fluidly coupled to an outlet port of the fluid injector assembly and disposed downstream of the fluid injector assembly along a direction of fluid flow through the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly; a pressure sensor fluidly coupled to the pressure measurement port; and a controller operatively coupled to the fluid conditioning module and the pressure sensor. The controller is configured to adjust a flowrate of a fluid through the injector assembly inlet conduit based on a pressure signal from the pressure sensor.

Another aspect of the disclosure provides a method for operating a fluid conditioning system. The fluid conditioning system includes a fluid injector assembly; a fluid conditioning module having an outlet port that is fluidly coupled to an inlet port of the fluid injector assembly via an injector assembly inlet conduit; an injector assembly outlet conduit fluidly coupled to an outlet port of the fluid injector assembly and disposed downstream of the fluid injector assembly along a direction of fluid flow through the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly; and a pressure sensor fluidly coupled to the pressure measurement port. The method comprises receiving within a controller a pressure signal from the pressure sensor; generating within the controller a control signal based on the pressure signal; adjusting a flowrate of a fluid through the injector assembly inlet conduit by transmitting the control signal from the controller to the fluid conditioning module.

DETAILED DESCRIPTION

Aspects of the disclosure will now be described in detail with reference to the drawings, wherein like reference numbers refer to like elements throughout, unless specified otherwise.

Figure 1:
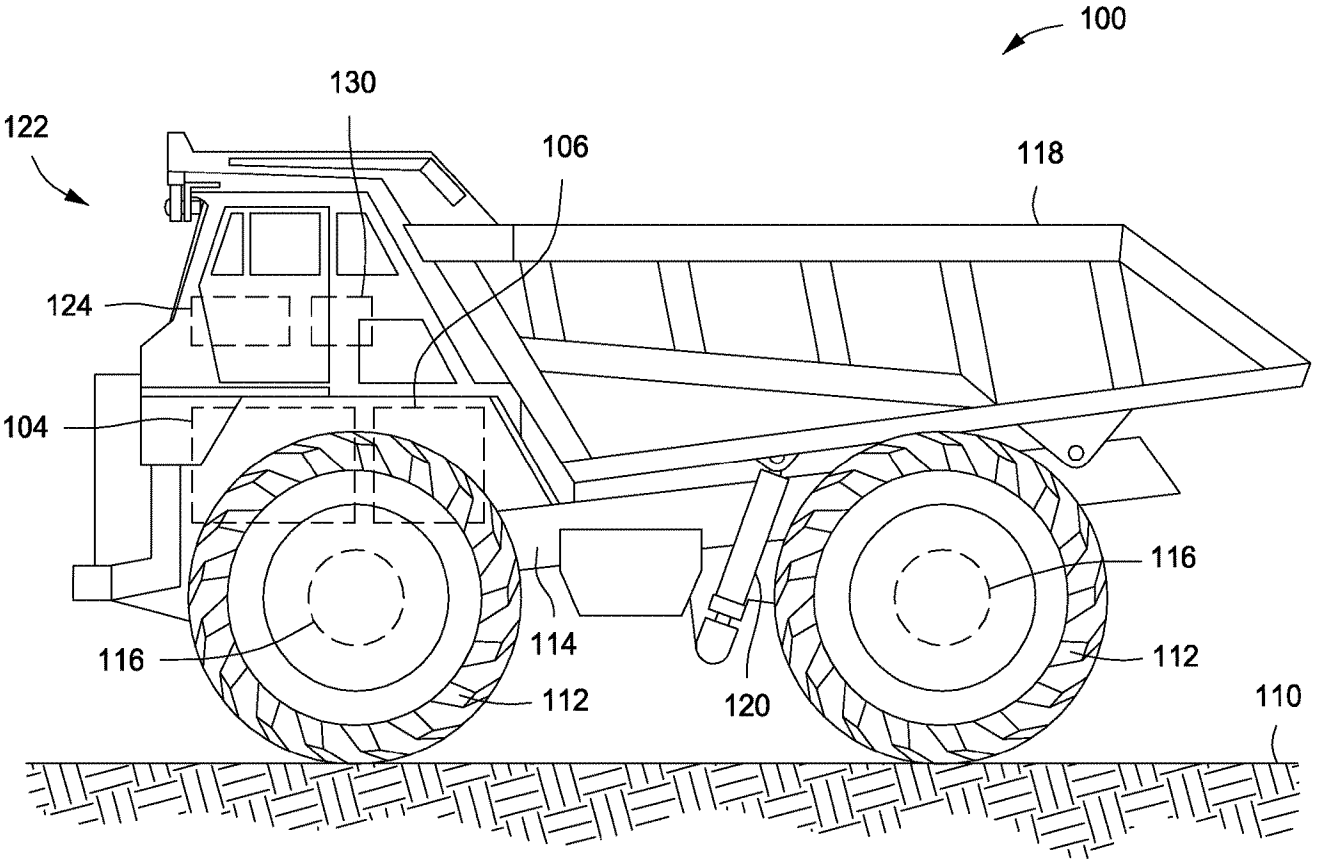
FIG. 1 is a schematic side view of a machine, according to an aspect of the disclosure.

FIG. 1 shows a side view of a machine 100, according to an aspect of the disclosure. The machine 100 includes an internal combustion (IC) engine 104 that is fluidly coupled to a fuel supply system 106. The IC engine 104 maybe a reciprocating internal combustion engine, such as a compression ignition engine or a spark ignition engine, for example, or a rotating internal combustion engine, such as a gas turbine, for example.

The machine 100 may be propelled over a work surface 110 by wheels 112 coupled to a chassis 114. The wheels 112 may be driven by motors 116, a mechanical transmission coupled to the IC engine 104, or combinations thereof. It will be appreciated that the machine 100 could also be propelled by tracks (not shown), combinations of wheels 112 and tracks, or any other surface propulsion device known in the art. Alternatively, the machine 100 could be a stationary machine, and therefore may not include a propulsion device.

The machine 100 may also include a work implement 118 driven by an actuator 120. The work implement 118 could be a dump bed, a shovel, a drill, a fork lift, a feller-buncher, a conveyor, or any other implement known in the art for performing work on a load. The actuator 120 may be a hydraulic actuator, such as a linear hydraulic motor or a rotary hydraulic motor, an electric motor, a pneumatic actuator, or any other actuator known in the art.

The machine may include a cab 122 configured to accommodate an operator, and have a user interface 124 including using input devices for asserting control over the machine 100. The user interface 124 may include pedals, wheels, joysticks, buttons, touch screens, combinations thereof, or any other user input device known in the art. Alternatively or additionally, the user interface 124 may include provisions for receiving control inputs remotely from the cab 122, including wired or wireless telemetry, for example. The IC engine 104, the fuel supply system 106, and the user interface 124 may be operatively coupled to one another via a machine controller 130.

The machine may be an "over-the-road" vehicle such as a truck used in transportation or may be any other type of machine that performs some type of operation associated with an industry such as mining, construction, farming, transportation, or any other industry known in the art. For example, the machine may be an off-highway truck; an earth-moving machine, such as a wheel loader, an excavator, a dump truck, a backhoe, a motor grader, or a material handler; a marine vessel; a locomotive; or any other machine known in the art. The term "machine" can also refer to stationary equipment, such as a generator that is driven by an internal combustion engine to generate electricity; a pump or a compressor that is driven by an internal combustion engine, or any other stationary drive machine known in the art. The specific machine 100 illustrated in FIG. 1 is a dump truck having a dump bed 118 actuated by a linear hydraulic cylinder 120.

Figure 2:
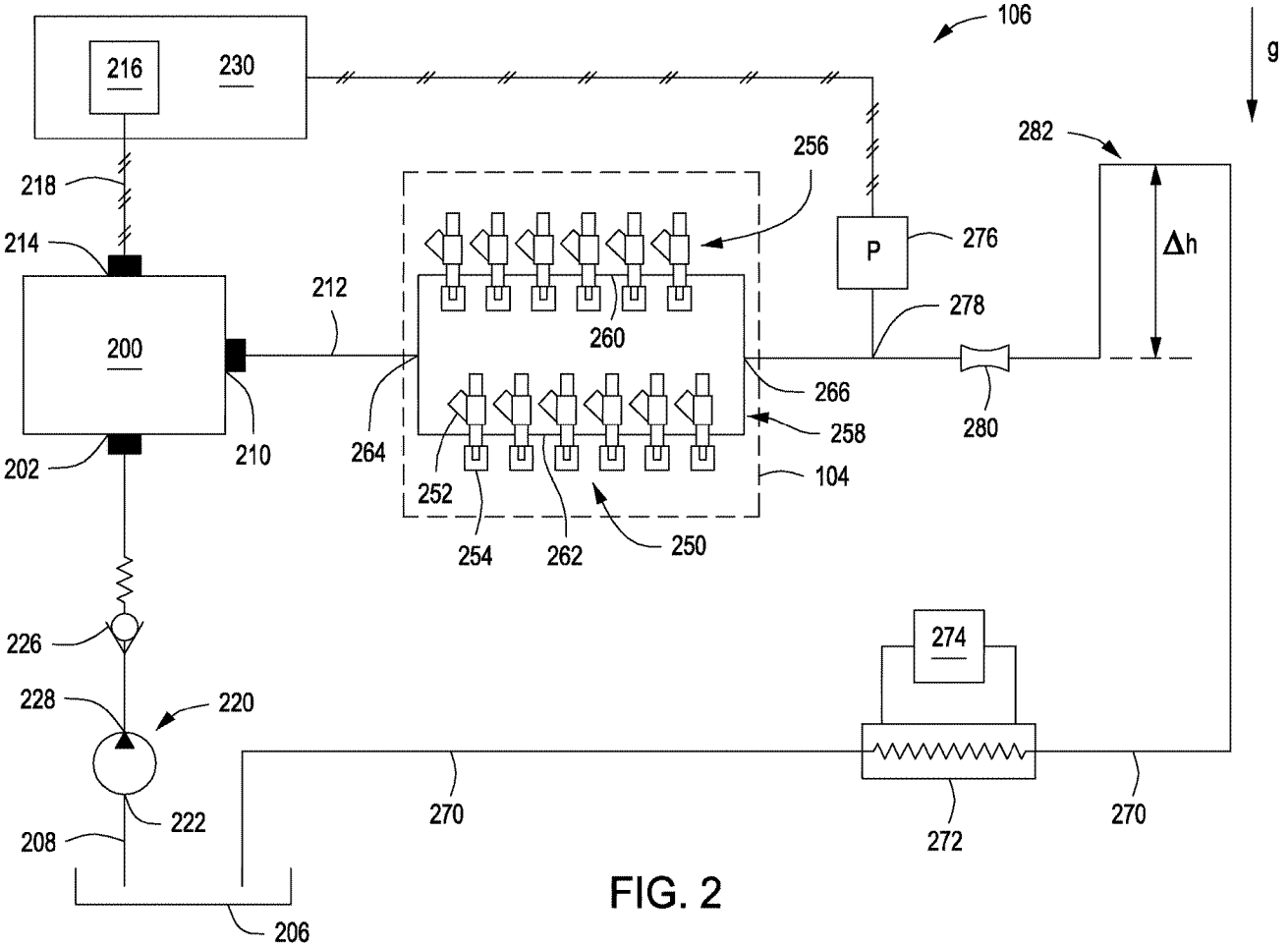
FIG. 2 is a schematic view of a fluid injection system, according to an aspect of the disclosure.

FIG. 2 shows a schematic view of a fuel supply system 106, according to an aspect of the disclosure. The fuel supply system 106 includes a fluid conditioning module 200 having an inlet port 202 that is in fluid communication with a fluid reservoir 206 via a suction conduit 208. The fluid reservoir 206 may be a liquid fuel reservoir that supplies one or more liquid fuels to the IC engine 104, such as, distillate diesel, biodiesel, dimethyl ether, seed oils, ethanol, methanol, combinations thereof, or any other combustible liquid known in the art.

An outlet port 210 of the fluid conditioning module 200 may be in fluid communication with the IC engine 104 via a module outlet conduit 212. The fluid conditioning module 200 may include pumps, valves, filters, sensors, heaters, coolers, controllers, combinations thereof, or any other structures known in the art to be beneficial to conditioning a fluid. According to an aspect of the disclosure, the fluid conditioning module 200 includes a high-pressure common rail fuel pump.

A power port 214 of the fluid conditioning module 200 is operatively coupled to a power source 216 via a power conduit 218. The power source 216 may be an electrical power source, a hydraulic power source, a pneumatic power source, a shaft power source, combinations thereof, or any other power source known in the art. The power conduit 218 may include an electrical conductor, a fluid conduit, a shaft, combinations thereof, or any other means for transmitting power or control signals known in the art. Further, the power conduit 218 may also be configured to transmit communication signals between the fluid conditioning module 200 and a controller 230, such as instrumentation signals, for example.

According to an aspect of the disclosure, the power source 216 is an electrical power source, and the power conduit 218 consists of one or more electrical conductors. According to another aspect of the disclosure, the power source 216 is part of the controller 230. It will be appreciated that the controller 230 may be integrated with the machine controller 130 or a controller for the engine 104, or the controller 230 may be distinct from the machine controller 130, an engine controller, or both.

The fluid conditioning module 200 may be fluidly coupled to the fluid reservoir 206 via a low-pressure transfer pump 220, which takes suction from the fluid reservoir 206 via the suction conduit 208. Alternatively, the fluid conditioning module 200 includes a pump, and the fluid reservoir 206 may provide sufficient net positive suction head to the fluid conditioning module 200 such that the low-pressure transfer pump 220 is not necessary, and is therefore not included in the fuel supply system 106.

An inlet 222 of the low-pressure transfer pump 220 may be fluidly coupled to the fluid reservoir 206 via suction conduit 208, and an outlet 228 of the low-pressure transfer pump 220 may be coupled to the inlet port 202 of the fluid conditioning module 200 via a check valve 226. Alternatively, the check valve 226 may be disposed upstream of the low-pressure transfer pump 220 along a flow direction from the reservoir 206 to the fluid conditioning module 200. Further, it will be appreciated that the inlet port 202 of the fluid conditioning module 200 may be fluidly coupled to the fluid reservoir 206 via the check valve 226 independent of whether the fuel supply system 106 includes the low-pressure transfer pump 220. The check valve 226 is configured to allow flow through the suction conduit 208 only in a direction from the fluid reservoir 206 toward the fluid conditioning module 200.

According to the aspect illustrated in FIG. 2, the outlet port 210 of the fluid conditioning module 200 is fluidly coupled to the IC engine 104 via a fluid injector assembly 250. The fluid injector assembly 250 may include one or more fuel injectors 252 operatively coupled to combustion chambers 254 of the IC engine 104 for delivering fuel to the combustion chambers 254 defined at least in part by a block of the IC engine 104. According to another aspect of the disclosure, the fluid injector assembly 250 includes one or more exhaust aftertreatment fluid injectors that are fluidly coupled to an exhaust duct of the IC engine 104 and configured to deliver exhaust aftertreatment fluid to an exhaust flow through the exhaust duct.

The one or more fuel injectors 252 may include a first bank of fuel injectors 256 and a second bank of fuel injectors 258, such that the fuel injectors 252 composing the first bank of fuel injectors 256 are fluidly plumbed in series with one another along a first fuel rail 260, and the fuel injectors 252 composing the second bank of fuel injectors 258 are fluidly plumbed in series with one another along a second fuel rail 262. The first bank of fuel injectors 256 may be plumbed in parallel with the second bank of fuel injectors 258, such that the first bank of fuel injectors 256 and the second bank of fuel injectors 258 share a common fluid inlet 264 and a common fluid outlet 266. Alternatively, the one or more fuel injectors 252 may be fluidly plumbed in series with one another along a single fuel rail, or any other fluid arrangement to suit a particular application.

According to an aspect of the disclosure, the first fuel rail 260, the second fuel rail 262, or both, may be defined by flow passages within a block or cylinder head of the IC engine 104. However, it will be appreciated that the first fuel rail 260, the second fuel rail 262, or both, may be defined by tubing disposed outside a block or cylinder head of the IC engine 104.

The fluid reservoir 206 may be in fluid communication with a return conduit 270. The return conduit 270 may optionally include a heat exchanger 272 that is configured to transfer heat away from a flow of fuel through the return conduit 270. The heat exchanger 272 may be fluidly and/or thermally coupled to a heat transfer fluid source 274 to transfer heat away from the heat exchanger 272. The heat transfer fluid source 274 may include a source of coolant for the IC engine 104, a source of ambient air, or a source of any other cooling fluid medium known in the art.

The fluid conditioning system may include a pressure sensor 276 fluidly coupled to a pressure measurement port 278 along the return conduit 270. According to an aspect of the disclosure, the pressure measurement port 278 may be defined by a block or cylinder head of the engine 104. The pressure sensor 276 may be operatively coupled to the controller 230 for receipt of electrical power, transmission of a pressure signal indicative of a pressure at the pressure measurement port 278, or combinations thereof The fluid conditioning system may also include a flow-restricting orifice 280 disposed fluidly in series with the pressure measurement port 278 along the return conduit 270, and downstream of the pressure measurement port 278 along a flow direction through the fuel injector assembly 250.

As shown in FIG. 2, both the pressure measurement port 278 and the flow-restricting orifice 280 are disposed downstream of the common fluid outlet 266 of the fuel injector assembly 250 along a flow direction through the return conduit 270. According to another aspect of the disclosure, the pressure measurement port 278, the flow-restricting orifice 280, or both, may be disposed downstream of a most downstream fuel injector of the fuel injector assembly 250 along a flow direction through the fuel injector assembly 250. However, it will be appreciated that other arrangements of the pressure measurement port 278, the flow-restricting orifice 280 may be employed to suit other applications without departing from the scope of the present disclosure.

According to an aspect of the disclosure, the flow-restricting orifice 280 has a flow area that is smaller than a flow area of the return conduit 270 at the pressure measurement port 278. According to another aspect of the disclosure, the flow-restricting orifice 280 has a flow area that is no greater than half of a flow area of the return conduit 270 at the pressure measurement port 278. According to another aspect of the disclosure, the flow-restricting orifice 280 has a flow area that is smaller than a flow area of the first fuel rail 260, the second fuel rail 262, or both. According to another aspect of the disclosure, the flow-restricting orifice 280 has a flow area that is smaller than half of a flow area of the first fuel rail 260, the second fuel rail 262, or both.

The return conduit 270 may include an elevated portion 282 that has an elevation, with respect to the gravity direction (g), that is higher ($\Delta h$) than an elevation of fuel within the fuel injector assembly 250. As shown in FIG. 2, the elevated portion 282 is located downstream of the pressure measurement port 278 and the flow-restricting orifice 280 along a flow direction through the return conduit 270. However, it will be appreciated that the elevated portion 282 may be located anywhere downstream of the fuel injector assembly 250 and upstream of the reservoir 206 along a flow direction through the return conduit 270.

According to an aspect of the disclosure, the elevated portion 282 has an elevation that is greater than a highest elevation of fuel within the fuel injector assembly 250. According to another aspect of the disclosure, the elevated portion 282 has an elevation that is more than one inch greater than a highest elevation of fuel within the fuel injector assembly 250. According to another aspect of the disclosure, the elevated portion 282 has an elevation that is more than a highest elevation of fuel within the fuel injector assembly plus an internal diameter of at least one of the return conduit 270, the first fuel rail 260, and the second fuel rail 262. According to another aspect of the disclosure, the elevated portion 282 has an elevation that is greater than any other elevation of fuel within the fuel supply system 106 with respect to the gravity direction (g).

Although the fluid conditioning module 200 is shown in the context of a fuel supply system 106 in FIG. 2, it will be appreciated that the fluid conditioning module 200 could be used to condition and supply other fluid injection systems with other fluids, such as, hydraulic fluid, coolant, water, lubricating oil, exhaust aftertreatment fluid, combinations thereof, or any other fluid known in the art. For example, fuel injector assembly 250 could be an exhaust aftertreatment fluid injection assembly that is configured to inject exhaust aftertreatment fluid into an exhaust stream of the IC engine 104 instead of the combustion chambers 254 of the IC engine 104. Exhaust aftertreatment fluid may include a reductant, such as urea or ammonia, or any other fluid known in the art to benefit emissions aftertreatment of exhaust gas from an internal combustion engine. Unless specified otherwise, the term "fluid" is used herein to describe gases, liquids, slurries, combinations thereof, or other similar matter that tends to flow in response to applied sheer stress.

Figure 3:
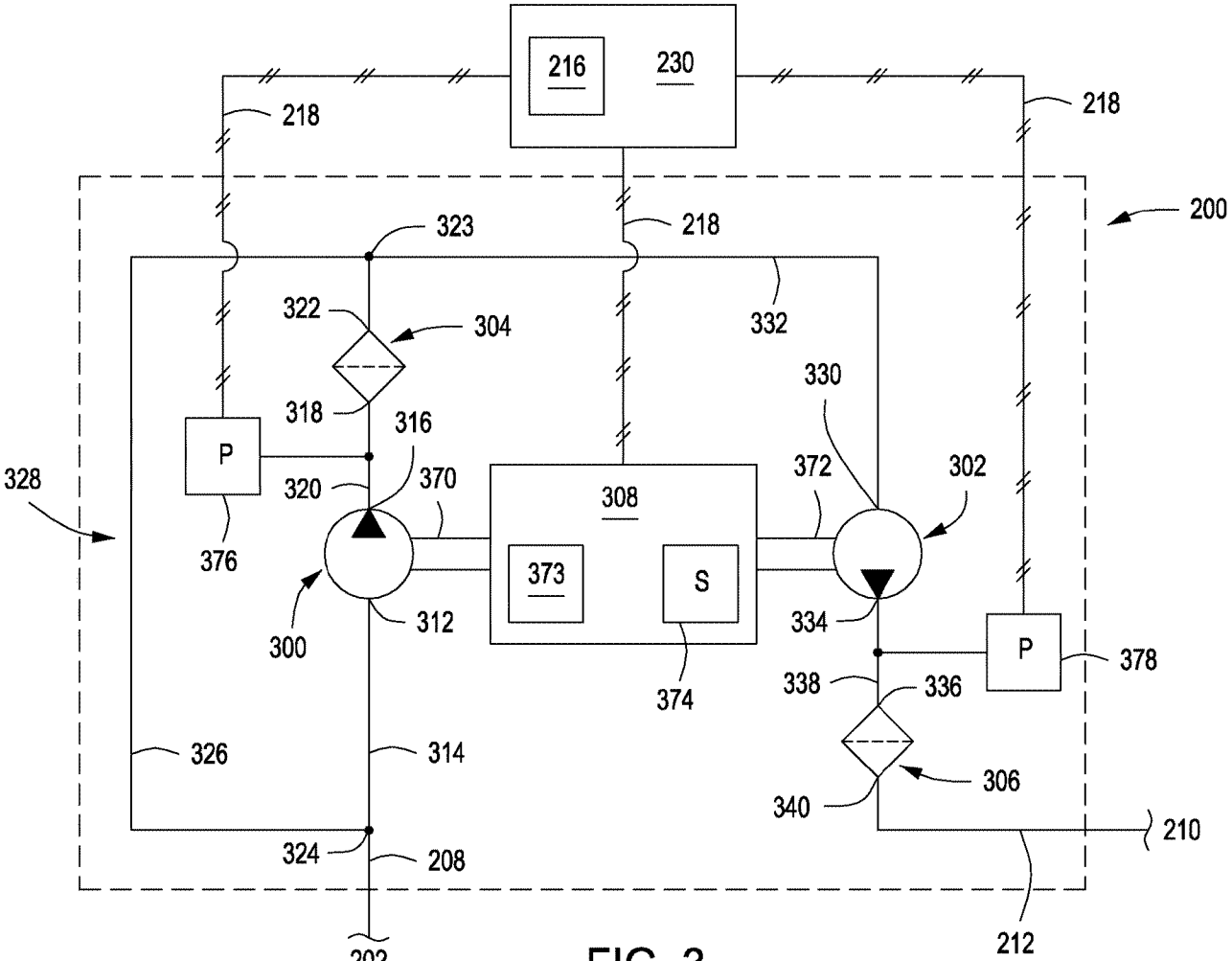
FIG. 3 is a schematic view of a fluid conditioning module, according to an aspect of the disclosure.

FIG. 3 shows a schematic view of a fluid conditioning module 200, according to an aspect of the disclosure. The fluid conditioning module 200 illustrated in FIG. 3 includes a recirculation pump 300, a delivery pump 302, a motor system 308, a first filter 304, and a second filter 306.

An inlet 312 to the recirculation pump 300 is fluidly coupled to the inlet port 202 of the fluid conditioning module 200, and therefore the fuel suction conduit 208, via a recirculation pump inlet conduit 314. An outlet 316 from the recirculation pump 300 is fluidly coupled to an inlet port 318 of the first filter 304 via a first filter inlet conduit 320. An outlet port 322 of the first filter 304 is fluidly coupled to the recirculation pump inlet conduit 314 at a fluid node 324 via a first filter outlet conduit 326. Accordingly, the first filter inlet conduit 320, the first filter outlet conduit 326, and the recirculation pump inlet conduit 314 form a fluid recirculation loop 328, which includes the first filter 304, about the recirculation pump 300.

An inlet 330 to the delivery pump 302 is fluidly coupled to the outlet port 322 of the first filter 304 via a delivery pump inlet conduit 332. Further, the delivery pump inlet conduit 332 may be fluidly coupled to the first filter outlet conduit 326 at the fluid node 323.

According to an aspect of the disclosure, the recirculation pump 300 may be a turbomachine, such as, for example, a centrifugal pump. According to another aspect of the disclosure, the delivery pump 302 may have a positive displacement design, such as, for example, a gerotor or external gear pump construction. However, it will be appreciated that either the recirculation pump 300 or the delivery pump 302 may be a turbomachine, a positive displacement pump, or any other pump known in the art, to satisfy the needs of a particular application.

An outlet 334 from the delivery pump 302 is fluidly coupled to an inlet port 336 of the second filter 306 via a second filter inlet conduit 338. An outlet port 340 of the second filter 306 is fluidly coupled to the outlet port 210 of the fluid conditioning module 200 via the module outlet conduit 212.

The recirculation pump 300 is operatively coupled to the motor system 308 via a first shaft 370 for transmission of shaft power therebetween, and the delivery pump 302 is operatively coupled to the motor system 308 via a second shaft 372 for transmission of shaft power therebetween. The motor system 308 may be powered by electrical power, hydraulic power, pneumatic power, combinations thereof, or any other motor power source known in the art.

According to an aspect of the disclosure, the motor system 308 is configured to drive the first shaft 370 at the same angular velocity as the second shaft 372. According to another aspect of the disclosure, the motor system 308 may include gearing 373 operatively coupled to the first shaft 370, the second shaft 372, or both, such that an angular velocity for the first shaft 370 is different from the angular velocity of the second shaft according to a prescribed relationship as a function of the angular velocity of the motor system 308. The motor system 308 may include a speed sensor 374 that is operatively coupled to the controller 230 for transmitting a signal to the controller that is indicative of a speed of the motor system 308.

According to an aspect of the disclosure, the motor system 308 is a variable speed motor and the controller 230 is configured to vary a rotational speed of the motor system 308. Further, the controller 230 may be configured to vary a speed of the motor system 308 based on a comparison between a pressure signal from the pressure sensor 276 (see FIG. 2) and a predetermined threshold value. According to another aspect of the disclosure, the motor system 308 is a constant speed motor, and the controller 230 is configured to actuate the motor system 308 between a stopped condition and a fixed-speed condition.

The controller 230 may be any purpose-built processor for effecting control of the fluid conditioning module 200. It will be appreciated that the controller 230 may be embodied in a single housing, or a plurality of housings distributed throughout the fluid conditioning module 200. Further, the controller 230 may include power electronics, preprogrammed logic circuits, data processing circuits, volatile memory, non-volatile memory, software, firmware, input/output processing circuits, combinations thereof, or any other controller structures known in the art.

The fluid conditioning module 200 may include a pressure sensor 376 in fluid communication with the first filter inlet conduit 320 and operatively coupled to the controller 230 for transmitting a pressure signal to the controller 230 that is indicative of a pressure at the inlet port 318 of the first filter 304. Alternatively or additionally, the fluid conditioning module 200 may include a pressure sensor 378 in fluid communication with the second filter inlet conduit 338 and operatively coupled to the controller 230 for transmitting a pressure signal to the controller 230 that is indicative of a pressure at the inlet port 336 of the second filter 306.

Figure 4:
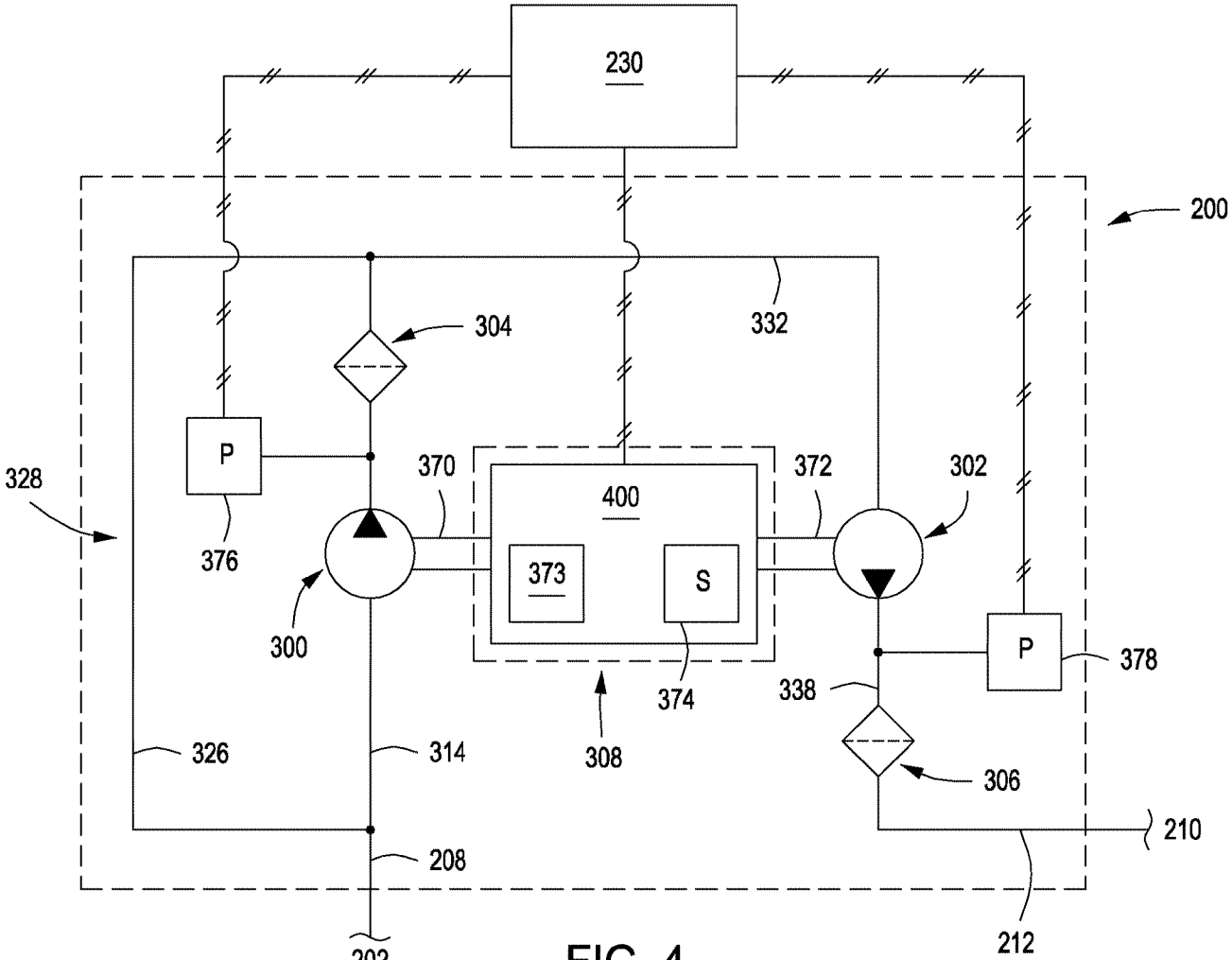
FIG. 4 is a schematic view of a fluid conditioning module, according to an aspect of the disclosure.

FIG. 4 shows a schematic view of a fluid conditioning module 200, according to an aspect of the disclosure. The fluid conditioning module 200 illustrated in FIG. 4 is similar to that illustrated in FIG. 3 in that it includes a recirculation pump 300, a delivery pump 302, a motor system 308, a first filter 304, and a second filter 306. However, as illustrated in FIG. 4, the motor system 308 consists of a single motor 400.

The recirculation pump 300 is operatively coupled to the motor 400 via a first shaft 370 for transmission of shaft power therebetween, and the delivery pump 302 is operatively coupled to the motor 400 via a second shaft 372 for transmission of shaft power therebetween. The motor 400 may be powered by electrical power, hydraulic power, pneumatic power, combinations thereof, or any other motor power source known in the art.

According to an aspect of the disclosure, the motor 400 is configured to drive the first shaft 370 at the same angular velocity as the second shaft 372. According to another aspect of the disclosure, the motor 400 may include gearing 373 operatively coupled to the first shaft 370, the second shaft 372, or both, such that an angular velocity for the first shaft 370 is different from the angular velocity of the second shaft according to a prescribed relationship as a function of the angular velocity of the motor system 308. The motor 400 may include a speed sensor 374 that is operatively coupled to the controller 230 for transmitting a signal to the controller that is indicative of a speed of the motor 400.

Figure 5:
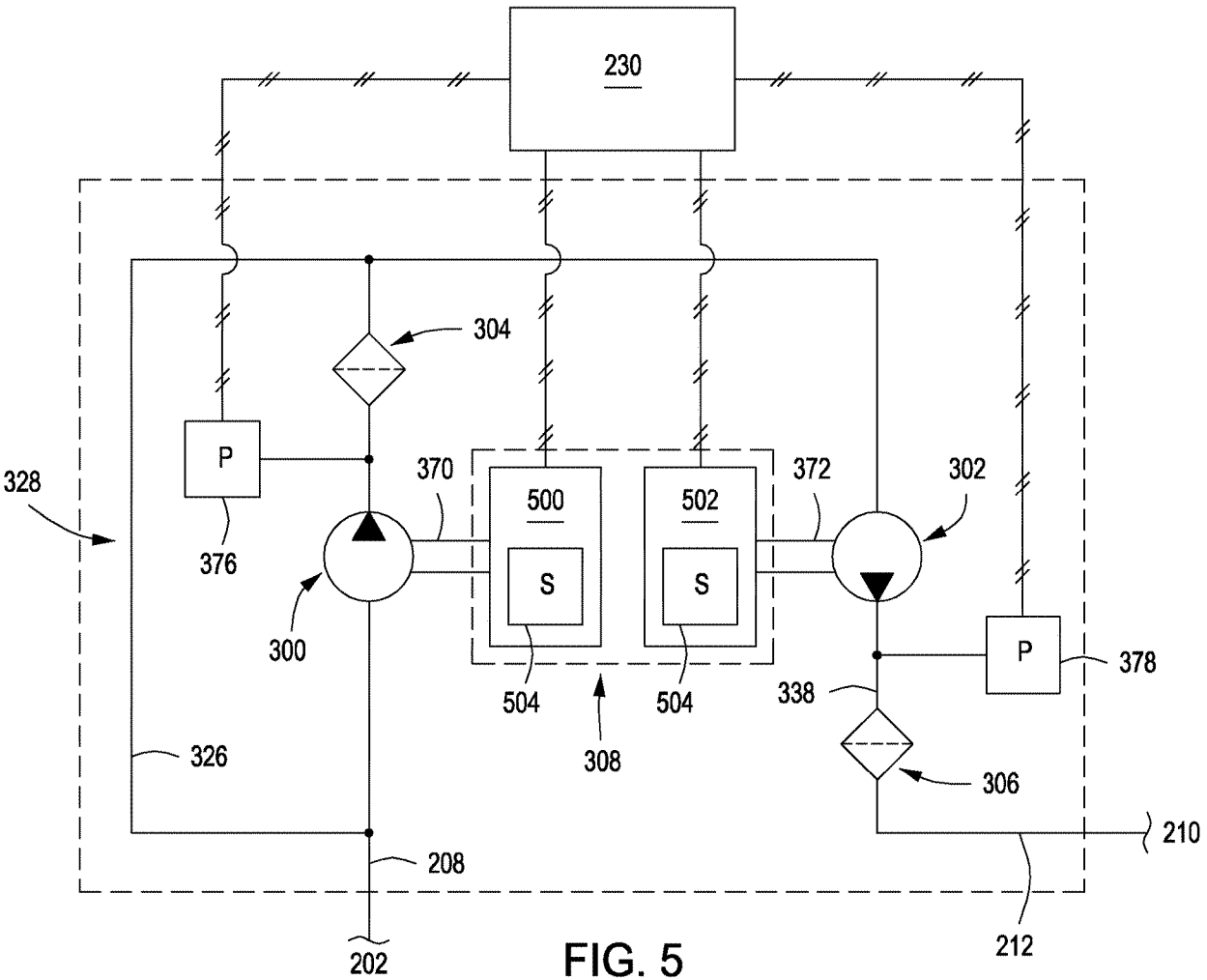
FIG. 5 is a schematic view of a fluid conditioning module, according to an aspect of the disclosure.

FIG. 5 shows a schematic view of a fluid conditioning module 200, according to an aspect of the disclosure. The fluid conditioning module 200 illustrated in FIG. 5 is similar to that illustrated in FIG. 3 in that it includes a recirculation pump 300, a delivery pump 302, a motor system 308, a first filter 304, and a second filter 306. However, as illustrated in FIG. 5, the motor system 308 includes a first motor 500 and a second motor 502.

The recirculation pump 300 is operatively coupled to the first motor 500 via a first shaft 370 for transmission of shaft power therebetween, and the delivery pump 302 is operatively coupled to the second motor 502 via a second shaft 372 for transmission of shaft power therebetween. Either the first motor 500 or the second motor 502 may be powered by electrical power, hydraulic power, pneumatic power, combinations thereof, or any other motor power source known in the art.

The delivery pump 302 is free from mechanical coupling with the first motor 500 via the second shaft 372, and the recirculation pump 300 is free from mechanical coupling with the second motor 502 via the first shaft 370. Further, the first motor 500 may be operatively coupled to the controller 230 separately and distinctly from a coupling between the second motor 502 and the controller 230. Accordingly, the controller 230 may effect independent control over the recirculation pump 300 and the delivery pump 302 as illustrated in FIG. 5. The first motor 500 may include a speed sensor 504 that is operatively coupled to the controller 230 for transmitting a signal to the controller 230 that is indicative of a speed of the first motor 500. The second motor 502 may include a speed sensor 506 that is operatively coupled to the controller 230 for transmitting a signal to the controller 230 that is indicative of a speed of the second motor 502.

According to an aspect of the disclosure, the controller 230 is configured to vary a speed of the first motor 500, the second motor 502, or both. According to another aspect of the disclosure, the controller 230 is configured to vary a speed of the second motor 502 and operate the first motor 500 at a constant speed.

Figure 6:
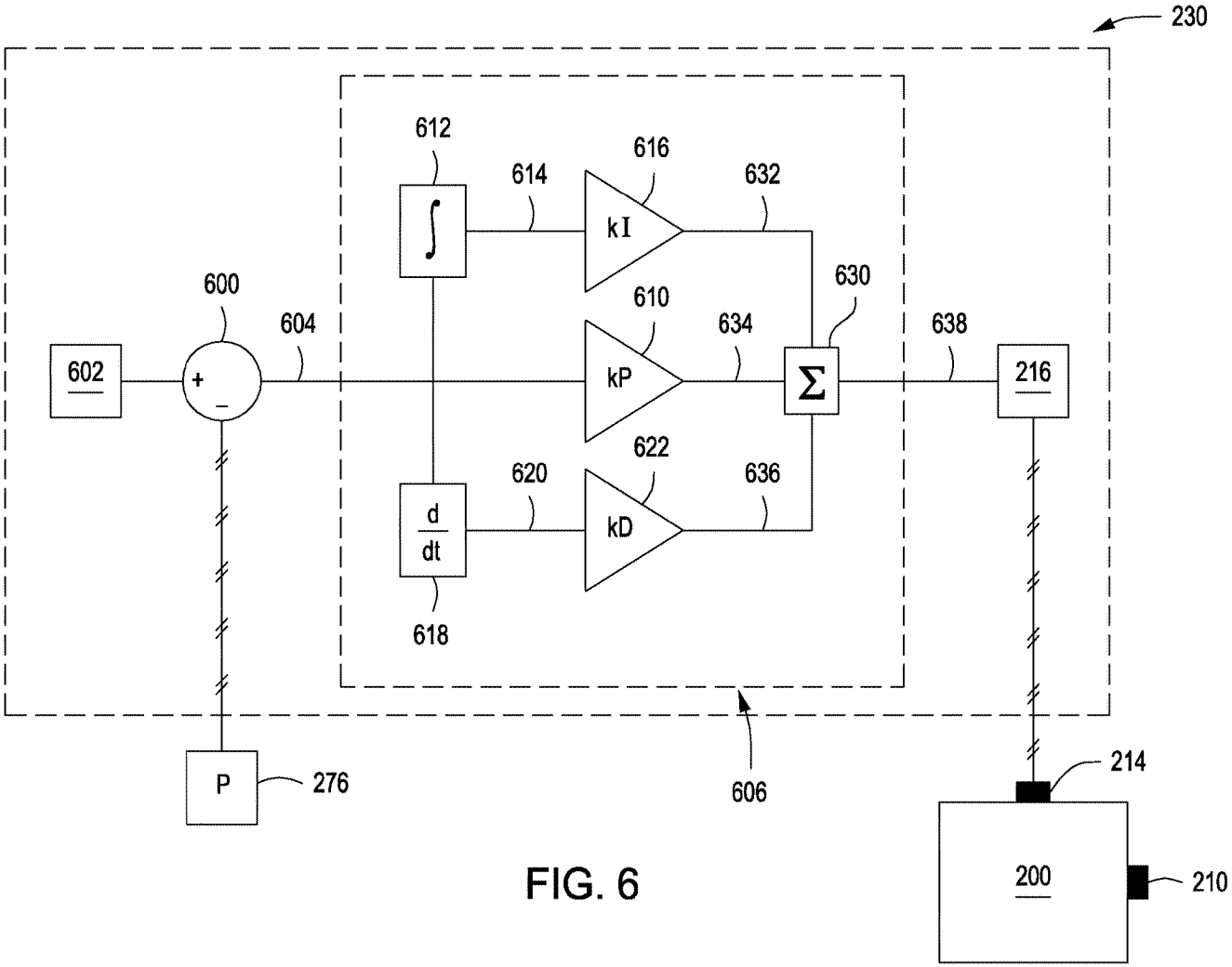
FIG. 6 is a schematic view of a controller, according to an aspect of the disclosure.

FIG. 6 shows a schematic view of a controller 230, according to an aspect of the disclosure. Comparator 600 receives a pressure signal from the pressure sensor 276 and receives a target pressure value 602 and determines an error signal 604 as a difference between the pressure signal from the pressure sensor 276 and the target pressure value 602. According to an aspect of the disclosure, the target pressure value 602 may vary with an operating parameter of the IC engine 104 such as engine speed or engine load, for example. The error signal 604 then proceeds to a gain module 606 of the controller 230.

In the gain module 606 the error signal 604 is scaled by a proportional gain (kP) in multiplication block 610. Optionally the gain module 606 may integrate the error signal 604 with time in integrator block 612 and scale the integrated error signal 614 by an integral gain (kI) in the multiplication block 616, or the gain module 606 may differentiate the error signal 604 with respect to time in the derivative block 618 and scale the differentiated error signal 620 by a derivative gain (kD) in the multiplication block 622. It will be appreciated that the gain module 606 may apply any combination of proportional gain (kP), integral gain (kI), and derivative gain (kD) to the error signal 604.

In the summation block 630, the gain module may add or otherwise superimpose the integrally-scaled error signal 632, the proportionally-scaled error signal 634, the differentially-scaled error signal 636, or combinations thereof to yield a module control signal 638. Further, the controller may amplify the module control signal 638 via the power source 216 and transmit the amplified control signal to the fluid conditioning module 200 to adjust a pressure, a flow rate, or both, of a fluid flow exiting the module outlet port 210. According to an aspect of the disclosure the amplified control signal from the controller 230 adjusts a speed of a motor in the motor system 308 to minimize an error between the pressure signal from the pressure sensor 276 and the target pressure value 602. Alternatively or additionally, the amplified control signal from the controller 230 may adjust a displacement of a pump in the fluid conditioning module 200 or vary a bypass flow around a pump in the fluid conditioning module, or take another control action known in the art to adjust a pressure, a flow rate, or both, of a fluid flow exiting the module outlet port 210.

Figure 7:
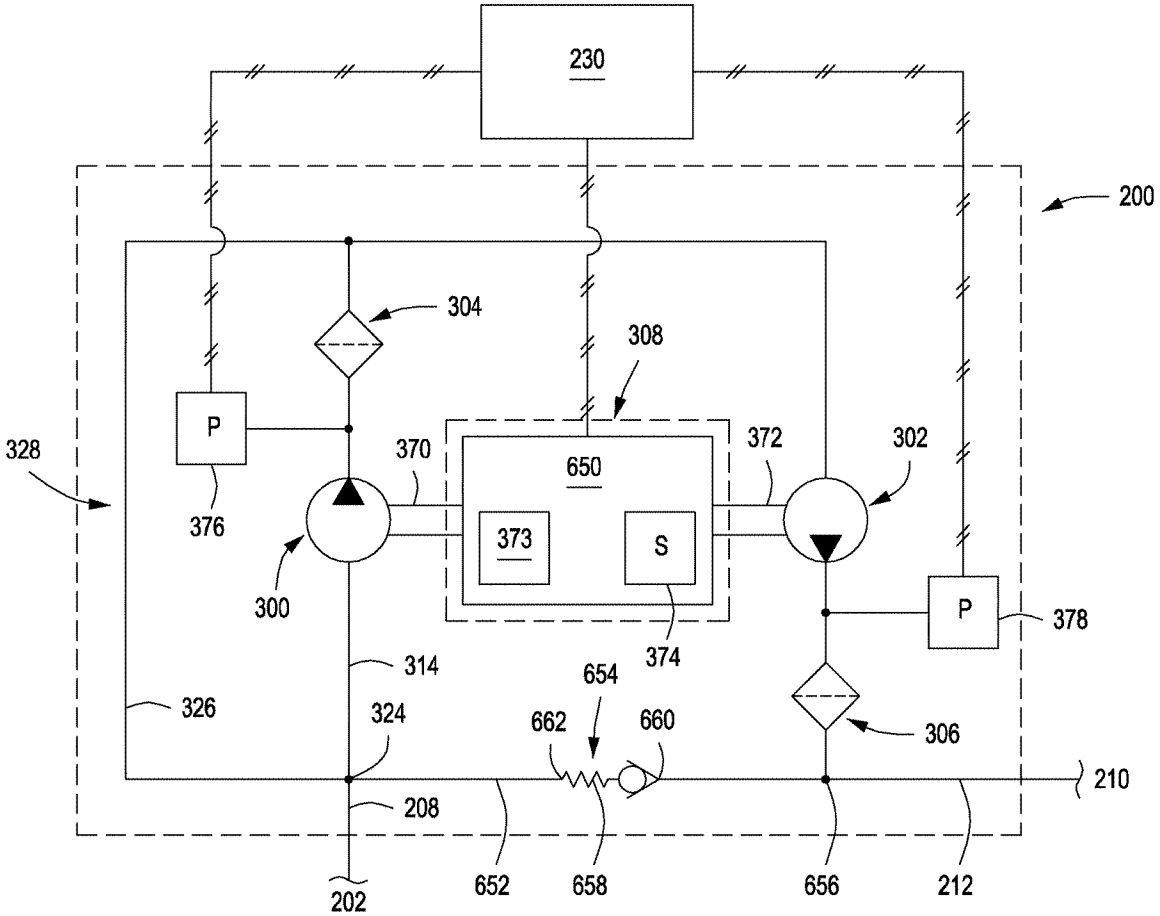
FIG. 7 is a schematic view of a fluid conditioning module, according to an aspect of the disclosure.

FIG. 7 shows a schematic view of a fluid conditioning module 200, according to an aspect of the disclosure. The fluid conditioning module 200 illustrated in FIG. 7 is similar to that illustrated in FIG. 3 in that it includes a recirculation pump 300, a delivery pump 302, a motor system 308, a first filter 304, and a second filter 306. However, as illustrated in FIG. 4, the motor system 308 consists of a single motor 650, and the recirculation pump inlet conduit 314 is in fluid communication with the module outlet conduit 212 via a regulation conduit 652 including a regulating valve 654.

The regulation conduit 652 may extend from a fluid node 656 on the module outlet conduit 212 to the fluid node 324 on the recirculation pump inlet conduit 314. According to an aspect of the disclosure, the regulating valve 654 is a spring check valve that is configured to allow flow through the regulation conduit 652 only in a direction from the module outlet conduit 212 toward the recirculation pump inlet conduit 314. Further, a resilience of the spring 658 in the spring check valve 654 may block fluid flow through the spring check valve 654 when the pressure at the inlet 660 is less than a prescribed value above the pressure at the outlet 662, and conversely effect fluid flow through the spring check valve 654 when the pressure at the inlet 660 is greater than or equal to the prescribed value above the pressure at the outlet 662. Accordingly, the regulating valve 654 may bleed excess pressure from the outlet of the delivery pump 302 to the inlet of the recirculation pump 300. According to an aspect of the disclosure, the regulating valve 654 is a spring check valve having a cracking pressure differential value of about 625 kiloPascals.

The recirculation pump 300 is operatively coupled to the motor 650 via a first shaft 370 for transmission of shaft power therebetween, and the delivery pump 302 is operatively coupled to the motor 650 via a second shaft 372 for transmission of shaft power therebetween. The motor 650 may be powered by electrical power, hydraulic power, pneumatic power, combinations thereof, or any other motor power source known in the art.

According to an aspect of the disclosure, the motor 650 is configured to drive the first shaft 370 at the same angular velocity as the second shaft 372. According to another aspect of the disclosure, the motor 650 may include gearing 373 operatively coupled to the first shaft 370, the second shaft 372, or both, such that an angular velocity for the first shaft 370 is different from the angular velocity of the second shaft according to a prescribed relationship as a function of the angular velocity of the motor system 308. The motor 650 may include a speed sensor 374 that is operatively coupled to the controller 230 for transmitting a signal to the controller that is indicative of a speed of the motor 650. According to an aspect of the disclosure, the controller 230 is configured to operate the motor 650 at a constant speed.

Figure 8:
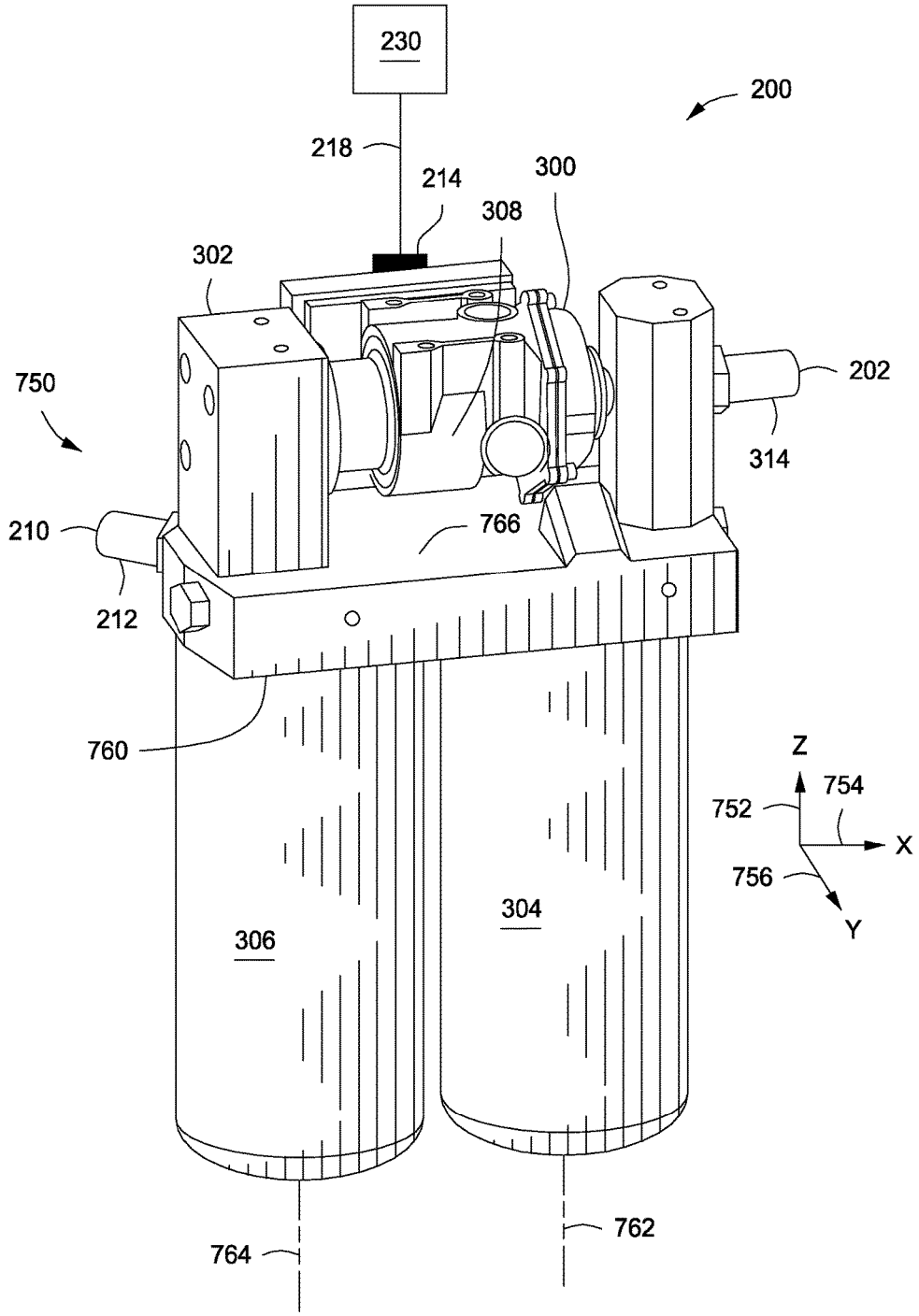
FIG. 8 is a perspective view of a fluid conditioning module, according to an aspect of the disclosure.

FIG. 8 shows a perspective view of a fluid conditioning module 200, according to an aspect of the disclosure. The fluid conditioning module 200 may include a block 750 that functions to provide points of attachment for any of the components of the fluid conditioning module 200, to define fluid passages to effect fluid communication between components of the fluid conditioning module 200, or combinations thereof. It will be appreciated that the block 750 may be formed and consist of a single unitary part, or alternatively, the block 750 may include a plurality of parts fastened to one another by threaded fasteners, rivets, welding, brazing, interference fits, combinations thereof, or any other material fasteners or techniques known in the art.

In FIG. 8, a height or vertical direction 752 extends along the z-axis, a width direction 754 extends along the x-axis, and a depth direction 756 extends along the y-direction, where the x-axis, the y-axis, and the z-axis may all be mutually normal or perpendicular to one another.

The first filter 304 and the second filter 306 are each mounted to a lower surface 760 of the block 750. A longitudinal axis 762 of the first filter 304 and a longitudinal axis 764 of the second filter 306 may each extend away from the lower surface 760 of the block along the height direction 752. The longitudinal axis 762 of the first filter 304 may be substantially parallel to the longitudinal axis 764 of the second filter 306. Further, the longitudinal axis 762 of the first filter 304 and the longitudinal axis 764 of the second filter 306 may each lie in a plane defined by the width direction 754 and the height direction 752.

The block 750 may define the inlet port 202, the outlet port 210, or both, of the fluid conditioning module 200. It will be appreciated that the block 750 may include fluid fittings coupled thereto, and that such fluid fittings may be said to be part of the block 750 and define the inlet port 202, the outlet port 210, or both.

The recirculation pump 300, the delivery pump 302, and the motor system 308 are shown fastened to an upper surface 766 of the block 750, where the upper surface 766 of the block 750 is opposite the lower surface 760 of the block along the height direction 752. The recirculation pump 300, the delivery pump 302, and the motor system 308 may be fastened to the block 750 by threaded fasteners, or any other fasteners known in the art.

INDUSTRIAL APPLICABILITY

The present disclosure is applicable to fluid conditioning systems in general, and more particularly to a fuel conditioning system for a fuel injection system for an internal combustion engine.

Aspects of the disclosure help to maintain a more stable and more repeatable fuel pressure within the fuel injector assembly 250 or other similar fluid injection systems through closed-loop control of a pressure downstream of the fuel injector assembly 250. Such closed-loop control may help to compensate for changing system operating characteristics that may arise over time, for example, as a result of filter loading, delivery pump wear, diminished motor performance, variations in fuel composition or temperature, variations in fuel flow consumed by the IC engine 104 throughout a duty cycle, or combinations thereof.

Reduced variance in fuel pressure within the fuel injector assembly 250 may provide degrees of freedom in engine or machine design to increase power, reduce fuel consumption, reduce regulated engine emissions, or combinations thereof. Indeed, operating margins reserved to account for variations in shot-to-shot fuel injector repeatability and cylinder-to-cylinder reproducibility may be reclaimed by reducing fuel supply pressure variations to improve operability and performance of the IC engine 104 or machine 100.

Further, aspects of the disclosure advantageously uncoupling operation of the fluid conditioning module 200 from engine speed by driving associated pumps within the fluid conditioning module 200 by an energy source having a potential that does not vary substantially with engine speed or load, such as an electrical energy source, and instead of more conventional direct shaft coupling between an IC engine 104 and fuel delivery pumps. In turn, smaller pump elements may be incorporated into the fluid conditioning module 200, thereby decreasing cost and packaging size for the fluid conditioning module 200 compared to more conventional approaches.

In addition, aspects of the disclosure achieve the improved fuel pressure control within the fuel injector assembly 250 without needing to employ mechanical pressure regulators, and may thereby improve overall fuel system reliability.

Incorporating the elevated portion 282 into the return conduit 270 (see FIG. 2) may help to maintain fluid levels within the fuel injector assembly 250 at advantageously full levels following an engine shutdown, thereby facilitating a subsequent engine restart by mitigating pump priming risks and by promoting ready accessibility of fuel to the injectors.

The controller 230 is configured to operate the recirculation pump 300 at a flow rate that is higher than a flow rate of the delivery pump 302, and the controller 230 may achieve this result in a number of ways depending upon the application.

Referring to FIG. 4, where both the recirculation pump 300 and the delivery pump 302 are driven by a single motor 400, the recirculation pump 300 may be selected to have a pumping characteristic such that, at the target pressure rise across the recirculation pump, the flow rate through the recirculation pump 300 is greater than the flow rate through the delivery pump 302, when the delivery pump 302 is also operated at its target pressure rise and the delivery pump 302 is operated at the same speed as the recirculation pump 300. Accordingly, for the aforementioned pumping characteristics and same-speed operation of the recirculation pump 300 and the delivery pump 302, the controller 230 is configured to operate the recirculation pump 300 at a higher flow rate than that of the delivery pump 302 by operating both the recirculation pump 300 and the delivery pump 302 at the same speed.

Alternatively, as discussed above, the motor 400 may include gearing 373, such that the recirculation pump 300 operates at a higher speed than the delivery pump 302 for any given operating speed of the motor 400. Accordingly, for the configuration where the recirculation pump 300 and the delivery pump 302 have substantially the same pumping characteristic, operating the recirculation pump 300 at a higher speed than the delivery pump 302, as a result of the gearing 373, the controller may be configured to operate the recirculation pump 300 at a higher flow rate than that of the delivery pump 302 by operating the motor 400 at a given speed or range of speeds. Further, it will be appreciated that the gearing 373 may be combined with different pumping characteristics for the recirculation pump 300 and the delivery pump 302 to achieve the desired relative flow rates between the recirculation pump 300 and the delivery pump 302.

Referring now to FIG. 5, where the recirculation pump 300 and the delivery pump 302 are operated independently by separate motors 500 and 502, respectively, it will be appreciated that the controller 230 may be configured to tailor the flow rate of the recirculation pump 300 relative to the flow rate of the delivery pump 302 by operating the first motor 400 and the second motor 402 at different speeds. As discussed previously, the first motor 500 and the second motor 502 may be variable speed motors, for example, and the controller 230 may tailor the speeds of the first motor 500 and the second motor 502 to achieve the desired relative flow rates from the recirculation pump 300 and the delivery pump 302.

Alternatively, if one of the first motor 500 and the second motor 502 were a variable speed motor and the other were a fixed speed motor, the controller 230 could tailor the relative flow rates between the recirculation pump 300 and the delivery pump 302 by varying the speed of the motor having variable speed capability. Further still, if the first motor 500 and the second motor 502 were each fixed speed motors, then the fixed speeds of the two motors could be selected in combination with the pumping characteristics of the recirculation pump 300 and the delivery pump 302 to effect the desired relative flow rates between the recirculation pump 300 and the delivery pump 302. Accordingly, the controller 230 would be configured to operate the recirculation pump 300 at a higher flow rate than the delivery pump 302 by operating the two fixed speed motors 500, 502 at different respective fixed speeds.

The controller 230 may be configured to monitor the operating speed of one or more motors in the motor system 308 and pressure signals from the pressure sensors 376, 378 (see FIG. 3) for purposes of identifying a filter loading level of the first filter 304, the second filter 306, or both. Further, the controller 230 may be configured to monitor a signal from the pressure sensor 378 and compare the pressure signal to a prescribed threshold value. The signal from the pressure sensor 378 dropping below the prescribed threshold value may be indicative a high loading state of the first filter 304, the second filter 306, or both. In response to identifying a high loading state of filters within the fluid conditioning module 200, the controller 230 may be configured to transmit a signal to the machine controller 130 or a display in the machine cab 122 informing an operator of the high filter loading condition within the fluid conditioning module 200.

Electrically driven pumps 300, 302 within the fluid conditioning module 200 may advantageously facilitate priming after filter service, as the engine need not be running to drive either the recirculation pump 300, the delivery pump 302, or both, but instead use electrical energy stored in a battery to operate the fluid conditioning module 200. Similarly, electrically driven pumps 300, 302 may provide advantages with respect to starting the IC engine 104, because the electrically driven pumps 300, 302 do not require shaft power from the engine to pressurize the fuel injector assembly 250 prior to starting the IC engine 104. In turn, the independently driven pumps 300, 302 may be operated before engaging a starter motor with the IC engine 104, to prime or otherwise pressurize the fuel injector assembly 250 before starting the IC engine 104.

Fuel injection pressures for direct injection compression ignition engines have increased over time at least partly in response to more stringent emissions regulations and incentives to improve fuel economy. And in response to this trend, Applicants have discovered that fuel injection system designs for higher injection pressures may exhibit higher sensitivity to fuel cleanliness, especially with respect to fuel-borne particulates. Further, the increased particulate sensitivity extends not only to the total volume fraction of particulates in the fuel, but also the maximum tolerable particle size. In turn, improved fuel filtration and conditioning systems can improve component service life through mitigation of surface wear and scuffing, heat-induced wear, or combinations thereof.

While conventional methods exist for improving filtration of fuel in a machine 100, Applicants recognized that the conventional methods tend to be bulky and expensive. As a result, Applicants have developed improvements to the conventional filtering methods within current design constraints for product packaging, cost, and maintainability, as described herein.

Referring to FIGS. 2-5, aspects of the disclosure provide a fluid conditioning module 200 including a recirculation pump 300 operating in a fluid recirculation loop 328 with a first filter 304, in addition to a delivery pump 302 for delivering fuel from the fluid recirculation loop 328 to an engine 104 via a second filter 306. Applicants discovered that improved fuel filtering could be achieved within the aforementioned packaging, cost, and maintainability constraints by operating the recirculation pump 300 a flow rate that is at least twice as high as the flow rate through the delivery pump 302. According to an aspect of the disclosure, the flow rate through the recirculation pump 300 is greater than or equal to five times greater than the flow rate through the delivery pump 302.

As a result, a parcel of fuel entering the fluid conditioning module 200 from the fluid reservoir 206 will likely flow through the first filter 304 multiple times before advancing to the engine 104 via the delivery pump 302 and the second filter 306, thereby improving fuel quality with each successive pass through the first filter 304. While some conventional systems may effect so-called "kidney loop" operation with a separate system that recirculates fuel back to a fuel reservoir, Applicants discovered packaging and cost advantages by incorporating the fluid recirculation loop 328 into the fluid conditioning module 200 without recirculation to the fluid reservoir 206. Instead, the delivery pump 302 takes suction from the fluid node 324, which is in fluid communication with the outlet port 322 of the first filter 304. In turn, Applicants have identified improvements in fuel system component service life, within established limits for fuel system packaging size and cost, especially for high-pressure direct injection fuel systems for a compression ignition engine.

Accordingly, during operation of the fluid conditioning module, a first flow of fuel enters the inlet 312 of the recirculation pump 300. The first flow of fuel may have originated from the inlet port 202 to the fluid conditioning module 200 or the fluid recirculation loop 328. The recirculation pump 300 drives the first flow of fuel through the first filter 304 and back to the fluid node 324.

At fluid node 323, the first flow of fuel may be split into a second flow of fuel that proceeds back to the inlet 312 of the recirculation pump 300, and a third flow of fuel that proceeds to the inlet 330 of the delivery pump 302. According to an aspect of the disclosure, the second flow of fuel constitutes about 50-75% of the first flow of fuel, with the balance proceeding to the inlet 330 of the delivery pump 302.

Improvements to filtration performance are further realized by pressurization of the fuel entering the first filter 304 by the recirculation pump 300, which enables the use of finer filtration media in the first filter 304, the second filter 306, or both. For example, while some conventional approaches may only accommodate 10 μm filtration media within prescribed design constraints, aspects of the present disclosure enable use of finer 4 μm filtration media within the same design constraints; thereby further improving filtration performance and fuel quality. According to an aspect of the disclosure, the first filter 304 includes a single stage of 4 μm filtration media. According to another aspect of the disclosure, the first filter 304 includes a single stage of 4 μm filtration media, and the second filter includes two stages of 4 μm filtration media arranged in series. According to another aspect of the disclosure, the two stages of 4 μm filtration media in the second filter 306 are arranged coaxially in series with one another. However, persons having skill in the art will appreciate that either the first filter 304 or the second filter 306 may include multiple filter elements in a single filter housing, multiple filter housings, or combinations thereof.

It will be appreciated that standardized, modular, and compact nature of the fluid conditioning module 200 facilitates application and installation engineering, particularly in light of only three connections between the machine 100 and the fluid conditioning module 200, namely: the inlet port 202, the outlet port 210, and the power port 214. Further, the compact and modular design of the fluid conditioning module 200 advantageously lends itself for mounting on a fuel tank or the chassis 114 of a machine 100, thereby improving filtration performance by avoiding the higher vibration environment of the IC engine 104. Indeed, Applicants have discovered that vibration may diminish filtration performance through disruption of filter cake captured on filter media of the first filter 304 or the second filter 306.

Any of the methods or functions described herein may be performed by or controlled by the controller 230. Further, any of the methods or functions described herein may be embodied in a computer-readable non-transitory medium for causing the controller 230 to perform the methods or functions described herein. Such computer-readable non-transitory media may include magnetic disks, optical discs, solid state disk drives, combinations thereof, or any other computer-readable non-transitory medium known in the art. Moreover, it will be appreciated that the methods and functions described herein may be incorporated into larger control schemes for an engine, a machine, or combinations thereof, including other methods and functions not described herein.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A fluid injection system, comprising:

a fluid injector assembly;

a fluid conditioning module having an outlet port that is fluidly coupled to an inlet port of the fluid injector assembly via an injector assembly inlet conduit;

an injector assembly outlet conduit fluidly coupled to an outlet port of the fluid injector assembly and disposed downstream of the fluid injector assembly along a direction of fluid flow through the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly;

a pressure sensor fluidly coupled to the pressure measurement port; and a controller operatively coupled to the fluid conditioning module and the pressure sensor, the controller being configured to adjust a flowrate of a fluid through the injector assembly inlet conduit based on a pressure signal from the pressure sensor.

2. The fluid injection system of claim 1, wherein a flow area of the injector assembly outlet conduit at the flow-restricting orifice is less than a flow area of the injector assembly outlet conduit at the pressure measurement port.

3. The fluid injection system of claim 1, wherein the controller is further configured to scale a difference between the pressure signal and a target pressure value by a proportional gain.

4. The fluid injection system of claim 1, wherein the fluid conditioning module includes:

a motor system operatively coupled to the controller, a recirculation pump operatively coupled to the motor system, an outlet of the recirculation pump being fluidly coupled to an inlet of the recirculation pump via a first filter, a delivery pump operatively coupled to the motor system, an inlet of the delivery pump being fluidly coupled to an outlet of the first filter, an outlet of the delivery pump being fluidly coupled to the injector assembly inlet conduit.

5. The fluid injection system of claim 4, wherein the outlet of the delivery pump is fluidly coupled to the injector assembly inlet conduit via a second filter.

6. The fluid injection system of claim 4, wherein the controller is further configured to adjust the flowrate of the fluid through the injector assembly inlet conduit by adjusting a speed of the motor system.

7. The fluid injection system of claim 4, wherein the motor system includes a first motor operatively coupled to the delivery pump via a first shaft, the controller being further configured to adjust a speed of the first motor.

8. The fluid injection system of claim 7, wherein the recirculation pump is operatively coupled to the first motor via a second shaft.

9. The fluid injection system of claim 7, wherein the motor system further includes a second motor operatively coupled to the recirculation pump via a second shaft, the second motor being distinct from the first motor, the controller being further configured to operate the second motor at a constant speed.

10. The fluid injection system of claim 7, wherein the delivery pump is a positive displacement pump.

11. The fluid injection system of claim 1, further comprising a return conduit in fluid communication with an outlet of the flow-restricting orifice and a reservoir, wherein an elevated portion of the return conduit is disposed at an elevation that is higher than a highest fluid elevation within the fluid injector assembly with respect to a gravity direction.

12. The fluid injection system of claim 11, wherein the elevated portion of the return conduit is disposed at an elevation that is at least one inch higher than the highest fluid elevation within the fluid injector assembly with respect to the gravity direction.

13. The fluid injection system of claim 1, wherein the fluid injector assembly is a fuel injection assembly for a reciprocating internal combustion engine.

14. The fluid injection system of claim 1, wherein the fluid injector assembly is an exhaust aftertreatment fluid injection assembly that is fluidly coupled to an exhaust duct of the internal combustion engine.

15. The fluid injection system of claim 4, wherein the controller is further configured to effect a flowrate through the recirculation pump that is greater than a flowrate through the delivery pump.

16. A machine, comprising:

an internal combustion engine; and a fluid injection system operatively coupled to the internal combustion engine, the fluid injection system including a fluid injector assembly having at least one fluid injector in fluid communication with the internal combustion engine;

a fluid conditioning module having an outlet port that is fluidly coupled to an inlet port of the fluid injector assembly via an injector assembly inlet conduit;

an injector assembly outlet conduit fluidly coupled to an outlet port of the fluid injector assembly and disposed downstream of the fluid injector assembly along a direction of fluid flow through the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly;

a pressure sensor fluidly coupled to the pressure measurement port; and a controller operatively coupled to the fluid conditioning module and the pressure sensor, the controller being configured to adjust a flowrate of a fluid through the injector assembly inlet conduit based on a pressure signal from the pressure sensor.

17. The machine according to claim 16, wherein the at least one fluid injector is a plurality of fuel injectors, and each fuel injector of the plurality of fuel injectors is fluidly coupled to a combustion chamber of the internal combustion engine.

18. The machine according to claim 16, wherein the engine includes an exhaust duct, the at least one fluid injector is at least one exhaust aftertreatment fluid injector, and the at least one exhaust aftertreatment fluid injector is fluidly coupled to the exhaust duct.

19. A method for operating a fluid conditioning system, the fluid conditioning system including a fluid injector assembly;

a fluid conditioning module having an outlet port that is fluidly coupled to an inlet port of the fluid injector assembly via an injector assembly inlet conduit;

an injector assembly outlet conduit fluidly coupled to an outlet port of the fluid injector assembly and disposed downstream of the fluid injector assembly along a direction of fluid flow through the fluid injector assembly, the injector assembly outlet conduit defining a pressure measurement port and a flow-restricting orifice, the pressure measurement port being disposed upstream of the flow-restricting orifice along the direction of fluid flow through the fluid injector assembly; and a pressure sensor fluidly coupled to the pressure measurement port, the method comprising:

receiving within a controller a pressure signal from the pressure sensor;

generating within the controller a control signal based on the pressure signal;

adjusting a flowrate of a fluid through the injector assembly inlet conduit by transmitting the control signal from the controller to the fluid conditioning module.

20. The method of claim 19, wherein the generating the control signal based on the pressure signal includes scaling a difference between the pressure signal and a target pressure value by a proportional gain.

* * * * *